US006997165B2

(12) United States Patent
Stockner et al.

(10) Patent No.: US 6,997,165 B2
(45) Date of Patent: Feb. 14, 2006

(54) PRESSURE CONTROL VALVE FOR A FUEL SYSTEM

(75) Inventors: Alan R Stockner, Metamora, IL (US); Amy M Hess, Metamora, IL (US); Daniel R Ibrahim, Bloomington, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 10/741,019

(22) Filed: Dec. 19, 2003

(65) Prior Publication Data

US 2005/0133007 A1 Jun. 23, 2005

(51) Int. Cl.
*F02M 41/00* (2006.01)

(52) U.S. Cl. ..... 123/447; 123/467; 137/489.5; 137/489; 251/33

(58) Field of Classification Search ..... 123/446, 123/447, 456, 467; 137/489.5, 489; 251/33
See application file for complete search history.

(56) References Cited

U.S. PATENT DOCUMENTS 5,669,356 A * 9/1997 Wall et al. ..... 123/467
5,778,925 A * 7/1998 Cooke ..... 137/493.6
5,832,954 A * 11/1998 Shafer ..... 137/543.15
6,561,165 B1 5/2003 Hlousek

* cited by examiner

*Primary Examiner*—Weilun Lo

(57) ABSTRACT

A valve has a housing defining an interior of the valve. The valve has a first passage in the housing and a second passage in the housing. The valve has a flow limiter movable between a first position at which the first passage is in fluid communication with the second passage and a second position at which the first passage is not in fluid communication with the second passage. The valve has a flow restriction device movable between a first position at which a first flow rate is permitted into the interior of the valve and a second position at which a second flow rate is permitted out of the interior of the valve. The first flow rate is greater than the second flow rate.

22 Claims, 2 Drawing Sheets

PRESSURE CONTROL VALVE FOR A FUEL SYSTEM

TECHNICAL FIELD

This invention relates generally to a fuel system of an internal combustion engine and more specifically to a pressure control valve in a fuel system of an internal combustion engine.

BACKGROUND

As emission requirements continue to become more stringent, engine manufacturers and component suppliers continue to improve engine operation. One area that has received particular focus has been fuel injection systems. By more accurately controlling fuel injection, improved combustion can be achieved, providing better engine efficiency and reduced emissions.

One type of fuel injection system that has received much attention has been the common rail fuel system. In a common rail system, the fuel injector controls the injection of high-pressure fuel that the injector receives from a high-pressure fuel rail. The injector does not pressurize the fuel but simply controls injection by controlling the check valve.

Although common rail fuel systems provide good control of fuel injection, improvements to such systems are still necessary. Specifically, the end of a fuel injection event in a common rail fuel system often creates a pressure wave within the system. Such a pressure wave may travel through the system and affect the amount of fuel that is delivered to other fuel injectors in the system. Therefore, improper volumes of fuel may be injected into the engine.

One attempt to dampen such pressure waves in a common rail fuel system is shown in U.S. Pat. No. 6,561,165 ("the '165 patent"), issued to Hlousek on 13 May 2003. In the '165 patent, a large reservoir is contained within each fuel injector of the common rail fuel system. The reservoir is intended to help dampen any pressure waves reaching the fuel injector. However, the reservoir may have a negative influence on the starting behavior and dynamic behavior of the fuel system because it may increase the time required for changing the pressure within the fuel system.

The present invention addresses one or more of the problems set forth above.

SUMMARY OF THE INVENTION

The present specification discloses a fuel system having a fuel source, a fuel injector, and a valve. The valve has a first passage in fluid communication with the fuel source and a second passage in fluid communication with the fuel injector. The valve has a flow limiter movable between a first position at which the first passage is in fluid communication with the second passage and a second position at which the first passage is not in fluid communication with the second passage. The valve has a flow restriction device movable between a first position at which a first flow rate is permitted from the fuel source into the valve and a second position at which a second flow rate is permitted from the valve to the fuel source. The first flow rate is greater than the second flow rate.

In another embodiment of the present invention, a valve has a housing defining an interior of the valve. The housing has a first passage and a second passage. The valve has a flow limiter movable between a first position at which the first passage is in fluid communication with the second passage and a second position at which the first passage is not in fluid communication with the second passage. The valve has a flow restriction device movable between a first position at which a first flow rate is permitted into the interior of the valve and a second position at which a second flow rate is permitted out of the interior of the valve. The first flow rate is greater than the second flow rate.

In a further embodiment of the present invention, a fuel system has a fuel source, a fuel injector, and a valve. The valve has a first passage in fluid communication with the fuel source and a second passage in fluid communication with the fuel injector. The valve has a flow limiter movable between a first position at which the first passage is in fluid communication with the second passage and a second position at which the first passage is not in fluid communication with the second passage. The valve has a means for permitting a flow of a fuel at a first flow rate from the fuel source into the valve. The valve has a means for restricting to a second flow rate a flow of the fuel from the valve to the fuel source. The first flow rate is greater than the second flow rate.

DETAILED DESCRIPTION

Figure 1:
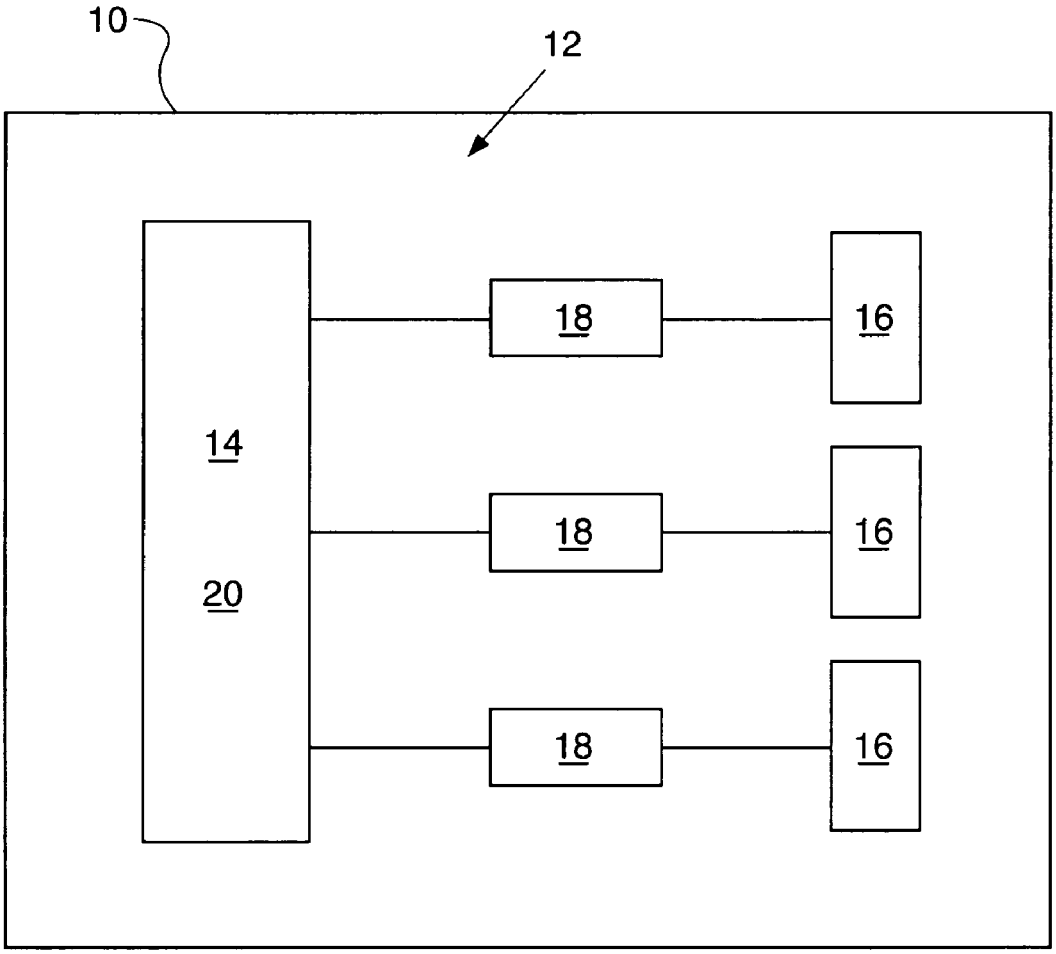
FIG. 1 is a diagrammatic view of a fuel system of an internal combustion engine.

Referring to FIG. 1, an internal combustion engine 10 has a fuel system 12. The fuel system 12 has a fuel source 14 and at least one fuel injector 16 configured to inject fuel into a cylinder (not shown). At least one pressure control valve 16 is positioned between the fuel source 14 and the at least one fuel injector 16. In the embodiment of FIG. 1, the fuel system 12 has one fuel source 14, three fuel injectors 16, and three pressure control valves 18. However, one of ordinary skill in the art will recognize that other numbers of fuel sources 14, fuel injectors 16, and pressure control valves 18 may be used. Also, in the embodiment of FIG. 1, the fuel source 14 of the fuel system 12 is a rail 20, such as those used in common rail fuel systems. However, in other embodiments the fuel source 14 may be an accumulator or another fuel source 14 known in the art.

Figure 3:
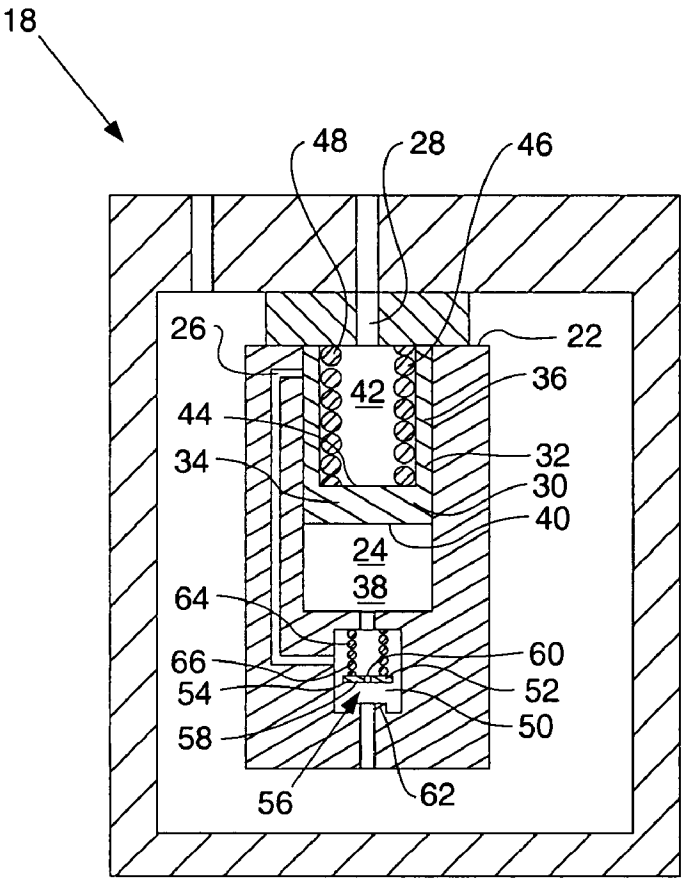
FIG. 3 is a cross-sectional view of another embodiment of a valve of the fuel system of FIG. 1.
Figure 2:
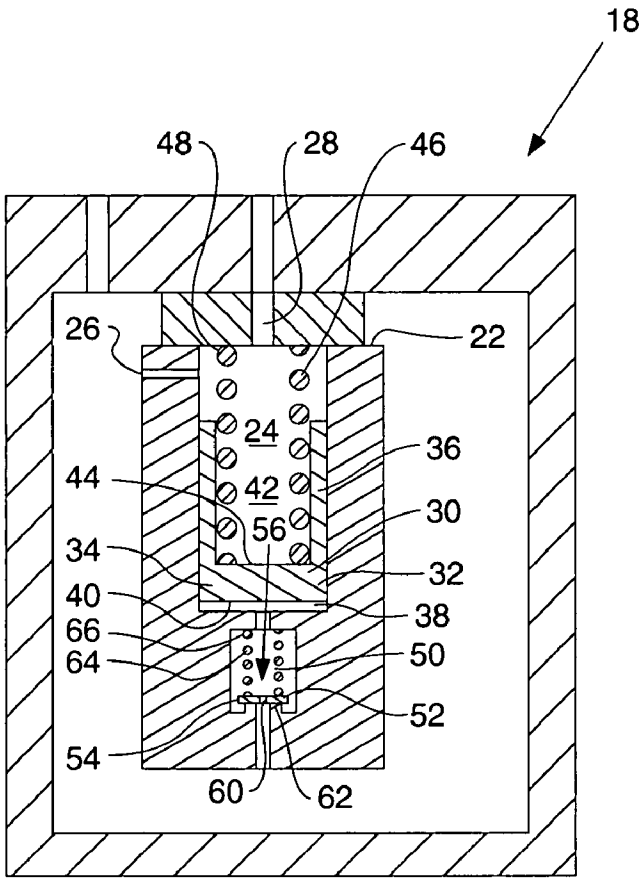
FIG. 2 is a cross-sectional view of an embodiment of a valve of the fuel system of FIG. 1.

Referring to FIG. 2, one embodiment of the pressure control valve 18 is shown. The pressure control valve 18 has a housing 22 defining an interior 24 of the pressure control valve 18. In the embodiments of FIG. 2 and FIG. 3, the housing 22 of the pressure control valve 18 is formed by several different pieces. However, in other embodiments the housing 18 may be formed by one integral piece. The housing 22 has a first passage 26 configured to permit a flow of a fuel into the interior 24 of the pressure control valve 18. The first passage 26 is in fluid communication with the fuel source 14. In FIG. 2, the housing 22 of the pressure control valve 18 also has a second passage 28 configured to permit a flow of the fuel out of the interior 24 of the pressure control valve 18. The second passage 28 is in fluid communication with the fuel injector 16.

In FIG. 2 and FIG. 3, the pressure control valve 18 has a flow limiter 30 disposed within the interior 24 of the pressure control valve 18. The flow limiter 30 is movable between a first position, as shown in FIG. 2, and a second position, as shown in FIG. 3. When the flow limiter 30 is in the first position, the first passage 26 is in fluid communication with the second passage 28. Thus, when the flow limiter 30 is in the first position, the fuel source 14 is in fluid communication with the fuel injector 16. When the flow limiter 30 is in the second position, the first passage 26 is not in fluid communication with the second passage 28. Thus, when the flow limiter 30 is in the second position, the fuel source 14 is not in fluid communication with the fuel injector 16.

In the embodiments of FIG. 2 and FIG. 3, the flow limiter 30 includes a piston 32. The piston 32 has a head 34 and a skirt 36 extending from the head 34. However, in other embodiments other structures may be substituted for the piston 32, such as discs, cylinders, spheres, and the like. The flow limiter 30 is sized such that there is a sliding fit between the flow limiter 30 and the housing 22 of the pressure control valve 18. Therefore, substantially all fuel flow between the flow limiter 30 and the housing 22 is prohibited. In the embodiments of FIG. 2 and FIG. 3, the flow limiter 30 separates the interior 24 of the housing 22 into a first portion 38, which is disposed between a first end 40 of the flow limiter 30 and the housing 22, and a second portion 42, which is disposed between a second end 44 of the flow limiter 30 and the housing 22. The relative volumes of the first portion 38 of the interior 24 and the second portion 42 of the interior 24 are dependent upon the position of the flow limiter 30 within the interior 24 of the housing 22.

In the embodiments of FIG. 2 and FIG. 3, the pressure control valve 18 has a biasing device 46 disposed within the interior 24 of the housing 22. The biasing device 46 is connected to the flow limiter 30. The biasing device 46 is configured to exert a force upon the flow limiter 30 in the direction of either the first position or the second position of the flow limiter 30. In the embodiments of FIG. 2 and FIG. 3, the biasing device 46 is configured to exert a force upon the flow limiter 30 in the direction of the first position of the flow limiter 30. In FIG. 2 and FIG. 3, the biasing device is a coil spring 48. However, one of ordinary skill in the art will recognize that other biasing devices may be substituted for the coil spring 48, including belleville washers, compressed elastic members, and the like.

In FIG. 2 and FIG. 3, the housing 24 of the pressure control valve 18 has a third passage 50. The third passage 50 is in fluid communication with the fuel source 14 and is in fluid communication with the interior 24 of the housing 22. In the embodiments of FIG. 2 and FIG. 3, the third passage 50 is in fluid communication with the first portion 38 of the interior 24 of the housing 22. In FIG. 2, the third passage 50 is connected to the fuel source 14 in parallel with the first passage 26. In FIG. 3, the third passage 50 is connected to the fuel source 14 in series with the first passage 26.

In the embodiments of FIG. 2 and FIG. 3, the pressure control valve 18 has a means for permitting 52 a flow of fuel at a first flow rate from the fuel source 14 into the pressure control valve 18. In the embodiments of FIG. 2 and FIG. 3, the pressure control valve 18 has a means for restricting 54 to a second flow rate a flow of fuel from the valve 18 to the fuel source 14, the first flow rate being greater than the second flow rate. In FIG. 2 and FIG. 3, both the means for permitting 52 and the means for restricting 54 is a flow restriction device 56. However, one or more other valve structures known in the art may be substituted for the flow restriction device 56 of FIG. 2 and FIG. 3 to perform either or both of the permitting and restricting functions. In FIG. 2 and FIG. 3, the flow restriction device 56 is disposed within the third passage 50 of the pressure control valve 18. However, in other embodiments, the flow restriction device 56 may be disposed within the first passage 26 of the pressure control valve 18.

The flow restriction device 56 is movable between a first position, shown in FIG. 3, at which the first flow rate of fuel is permitted from the fuel source 14 into the pressure control valve 18 and a second position, shown in *Fig.* 2, at which the second flow rate is permitted from the pressure control valve 18 to the fuel source 14. In the embodiments of FIG. 2 and FIG. 3, the flow restriction device 56 includes a disk 58 having an orifice 60 therethrough. However, other valve structures may be substituted for the disk 58, such as a sphere with an orifice therethrough, a gate valve, and the like. The pressure control valve 18 has a seat 62. When the flow restriction device 56 is in the second position, the disk 58 is in contact with the seat 62, such that substantially all flow around the disk 58 is prohibited.

In the embodiments of FIG. 2 and FIG. 3, the pressure control valve 18 includes a second biasing device 64 connected to the flow restriction device 56. The second biasing device 64 is configured to exert a force upon the flow restriction device 56 in the direction of either the first position or the second position of the flow restriction device 56. In the embodiments of FIG. 2 and FIG. 3, the second biasing device 64 is configured to exert a force upon the flow restriction device 56 in the direction of the second position of the flow restriction device 56. In FIG. 2 and FIG. 3, the second biasing device 64 is a coil spring 66. However, one of ordinary skill in the art will recognize that other biasing devices may be substituted for the coil spring 66, including belleville washers, compressed elastic members, and the like.

INDUSTRIAL APPLICABILITY

During operation of the fuel system 12, a fuel injection event starts when the fuel injector 16 begins to inject fuel into the cylinder of the internal combustion engine 10. The flow limiter 30 is in the first position and fuel is permitted to pass from the fuel source 14 through the first passage 26 of the pressure control valve 18 and into the interior 24 of the housing 22 of the pressure control valve 18. The fuel then exits the pressure control valve 18 through the second passage 28. The fuel enters the fuel injector 16 and is injected into the cylinder of the engine 10.

Operation of the fuel system 12 having the embodiment of the pressure control valve 18 shown in FIG. 2 will now be described. The flow of fuel from the first passage 26 through the valve 18 and through the second passage 28 causes a pressure difference to develop between the first portion 38 of the interior 24 of the housing 22 and the second portion 42 of the interior 24 of the housing 22. The pressure in the first portion 38 is greater than the pressure in the second portion 42. Therefore, the flow limiter 30 begins to move toward the second position of the flow limiter 30. As the flow limiter 30 moves toward the second position, the flow restriction device 56 permits fuel to pass from the fuel source 14 through the third passage 50 at a first flow rate. The flow restriction device 56 is in its first position. The first portion 38 of the interior 24 of the housing 22 of the pressure control valve 18 is filled with the flow of fuel via the third passage 50.

In a typical fuel injection cycle of the fuel system 12, the fuel injector 16 will cease the fuel injection event prior to the flow limiter 30 reaching the second position. However, in fuel injection cycles wherein a failure has occurred, such as when the fuel injector 16 is stuck open or when an end of the fuel injector 16 has been broken, the flow limiter 30 will reach the second position. Once the flow limiter 30 is in the second position, the first passage 26 is not in fluid communication with the second passage 28 and, therefore, fuel is not permitted to flow from the fuel source 14 to the fuel injector 16. The pressure exerted upon the flow limiter 30 by the fuel within the first portion 38 of the interior 24 of the housing 22 of the pressure control valve 18 is greater than the force exerted by the biasing device 46. Therefore, the flow limiter 30 is maintained in the second position until the fuel system 12 is reset. This operation of the pressure control valve 18 during a failure mode of the fuel injector 16 prevents excess fuel from entering the cylinder.

In a non-failure injection cycle, the fuel injector 16 ceases the fuel injection event prior to the flow limiter 30 reaching the second position. The closing of the fuel injector 16 at the end of the fuel injection event causes fuel to stop flowing from the fuel source 14 into the fuel injector 16 via the first passage 26 and second passage 28 of the pressure control valve 18. The combined force of the pressure of the fuel remaining within the second portion 42 of the interior 24 of the housing 22 of the pressure control valve 18 and the force of the biasing device 46 is greater than the pressure of the fluid within the first portion 38 of the housing 22 of the pressure control valve 18. Therefore, the fuel within the first portion 38 of the housing 22 is forced from the interior 24 of the pressure control valve 18 through the third passage 50 and to the fuel source 14. The force of the flow of the fuel through the third passage 50 combined with the force applied by the second biasing device 64 causes the flow restriction device 56 to contact the seat 62 of the pressure control valve 18. Therefore, the flow of fuel out of the interior 24 of the pressure control valve 18 via the third passage 50 is restricted to the second flow rate through the orifice 60 of the flow restriction device 56.

When the fuel injector 16 ends the fuel injection event, the fuel does not immediately cease to flow towards the fuel injector 16. The fuel that has already entered the fuel injector 16 via the second passage 28 of the pressure control valve 18 slams against the closed portion of the fuel injector 16, creating a pressure wave. The pressure wave travels into the pressure control valve 18 via the second passage 28 and contacts the flow limiter 30. A portion of the magnitude of the pressure wave passes through the first passage 26 of the pressure control valve 18 and travels to the fuel source 14. Another portion of the magnitude of the pressure wave is diminished by the friction between the flow limiter 30 and the housing 22 of the pressure control valve 18. The remainder of the pressure wave is passed to the fuel within the first portion 38 of the interior 24 of the pressure control valve 18. The pressure wave passes into the third passage 50 of the pressure control valve 18, but the magnitude of the pressure wave is greatly diminished when the fuel flow out of the third passage 50 is restricted by the flow restriction device 56 to the second flow rate. Thus, the magnitude of the pressure wave that reaches the fuel source 14 in a fuel system 12 having the pressure control valve 18 of the present invention is much less than the magnitude of a pressure wave that reaches a fuel source in a fuel system without the pressure control valve 18.

Operation of the fuel system 12 having the embodiment of the pressure control valve 18 shown in FIG. 3 is very similar to the operation of the fuel system 12 having the embodiment of the pressure control valve 18 shown in FIG. 2. However, the pressure control valve 18 of FIG. 3 restricts the combined flow of fuel out of the interior 24 of the pressure control valve 18 via both the first passage 26 and the third passage 50 to the second flow rate. All fuel passing from the pressure control valve 18 to the fuel source 14 must pass through the flow restriction device 56. Therefore, the pressure wave damping characteristics of the pressure control valve 18 of FIG. 3 are increased as compared to the embodiment of the pressure control valve 18 of FIG. 2. In the embodiment of FIG. 3, no portion of the pressure wave from the fuel injector 16 is permitted to pass unchecked through the first passage 26 and travel directly to the fuel source 14. Other operation of the embodiment of the pressure control valve 18 shown in FIG. 3 may be understood by referencing the discussion, above, of the operation of the embodiment of the pressure control valve 18 shown in FIG. 2.

Other aspects, objects, and advantages of this invention can be obtained from a study of the drawings, the disclosure, and the appended claims.

What is claimed is:

1. A fuel system, comprising:

a fuel source;

a fuel injector; and a valve having:

a first passage in fluid communication with said fuel source, a second passage in fluid communication with said fuel injector, a flow limiter movable between a first position at which said first passage is in fluid communication with said second passage and a second position at which said first passage is not in fluid communication with said second passage, and a flow restriction device movable between a first position at which a first flow rate is permitted from said fuel source into said valve and a second position at which a second flow rate is permitted from said valve to said fuel source, said first flow rate being greater than said second flow rate, said flow limiter being movable to said second position when said first flow rate is permitted from said fuel source into said valve.

2. The fuel system of claim 1 wherein said valve has a third passage in fluid communication with said fuel source, said flow restriction device being disposed in at least one of said first passage and said third passage.

3. The fuel system of claim 2 wherein said first passage and said third passage are connected in series.

4. The fuel system of claim 1 wherein said flow limiter includes a piston.

5. The fuel system of claim 1 including a biasing device connected to said flow limiter, said biasing device configured to exert a force upon said flow limiter in the direction of at least one of said first position and said second position.

6. The fuel system of claim 1 wherein said flow restriction device includes a disk having an orifice.

7. The fuel system of claim 1 including a second biasing device connected to said flow restriction device, said second biasing device configured to exert a force upon said flow restriction device in the direction of at least one of said first position and said second position.

8. The fuel system of claim 1 wherein said fuel source is a rail.

9. The fuel system of claim 1 wherein said fuel source is an accumulator.

10. A valve for use in a fuel system, said valve comprising:

a housing defining an interior of said valve;

a first passage in said housing, said passage configured to permit a flow of a fuel into said interior;

a second passage in said housing, said passage configured to permit a flow of said fuel from said interior;

a flow limiter movable between a first position at which said first passage is in fluid communication with said second passage and a second position at which said first passage is not in fluid communication with said second passage; and a flow restriction device movable between a first position at which a first flow rate of fuel is permitted into said interior and a second position at which a second flow rate of fuel is permitted out of said interior, said first flow rate being greater than said second flow rate, the fuel permitted into said interior at said first flow rate being capable of affecting movement of said flow limiter toward said second position.

11. The valve of claim 10 wherein said valve has a third passage in said housing, said flow restriction device being disposed in at least one of said first passage and said third passage.

12. The valve of claim 11 wherein said first passage and said third passage are connected in series.

13. The valve of claim 10 wherein said flow limiter includes a piston.

14. The valve of claim 10 including a biasing device connected to said flow limiter, said biasing device configured to exert a force upon said flow limiter in the direction of at least one of said first position and said second position.

15. The valve of claim 10 wherein said flow restriction device includes a disk having an orifice.

16. The valve of claim 10 including a second biasing device connected to said flow restriction device, said second biasing device configured to exert a force upon said flow restriction device in the direction of at least one of said first position and said second position.

17. A fuel system, comprising:

a fuel source;

a fuel injector; and a valve having:

a first passage in fluid communication with said fuel source, a second passage in fluid communication with said fuel injector, a flow limiter movable between a first position at which said first passage is in fluid communication with said second passage and a second position at which said first passage is not in fluid communication with said second passage, means for permitting a flow of a fuel at a first flow rate from said fuel source to said flow limiter, and means for restricting to a second flow rate a flow of said fuel from said flow limiter to said fuel source, said first flow rate being greater than said second flow rate.

18. The fuel system of claim 17 wherein said means for permitting is a flow restriction device.

19. The fuel system of claim 17 wherein said means for restricting is a flow restriction device.

20. The fuel system of claim 17 wherein said valve has a third passage in fluid communication with said fuel source, at least one of said means for permitting and said means for restricting being disposed in at least one of said first passage and said third passage.

21. The fuel system of claim 2 wherein said first passage and said third passage are connected in parallel.

22. The valve of claim 11 wherein said first passage and said third passage are connected in parallel.

* * * * *